US005211196A

United States Patent [19]

Schwelm

[11] Patent Number: 5,211,196

[45] Date of Patent: May 18, 1993

[54] PROPORTIONAL SEAT-TYPE 4-WAY VALVE

[75] Inventor: Hans Schwelm, Luxembourg-Dommeldange, Luxembourg

[73] Assignee: Hydrolux S.A.R.L., Luxembourg, Luxembourg

[21] Appl. No.: 751,774

[22] Filed: Aug. 29, 1991

[30] Foreign Application Priority Data

Aug. 31, 1990 [LU] Luxembourg ..... 87794

[51] Int. Cl.[5] ..... F15B 13/044

[52] U.S. Cl. ..... 137/596.2; 91/420; 91/446; 91/454; 91/464; 137/596.16

[58] Field of Search ..... 91/446, 454, 464, 420; 137/596.14, 596.16, 596.2

[56] References Cited

U.S. PATENT DOCUMENTS 4,201,052 5/1980 Breeden et al. ..... 91/454 X
4,266,466 5/1981 Ziems .
4,480,527 11/1984 Lonnemo ..... 91/454 X
4,531,449 7/1985 Reith ..... 91/420
4,646,622 3/1987 Ishizaki et al. ..... 91/454 X
4,711,267 12/1987 Schwelm ..... 137/596.16 X

FOREIGN PATENT DOCUMENTS 2212220A 7/1989 United Kingdom .

*Primary Examiner*—Gerald A. Michalsky
*Attorney, Agent, or Firm*—Mason, Fenwick & Lawrence

[57] ABSTRACT

A proportional valve comprises two electrically actuated proportional throttle valves, each having an outlet connected to a non-return valve, to each of which a seat valve is connected, each seat valve being pilot-controlled by one of the proportional throttle valves; the electric actuation of the proportional throttle valves proportionally controls and regulates the functions of a hydraulic cylinder. The two throttle valves and the two seat valves are mounted on a housing block which has a planar face at which are connections to a pressure line, a tank line and working lines.

5 Claims, 2 Drawing Sheets

PROPORTIONAL SEAT-TYPE 4-WAY VALVE

The invention concerns a porportional seat-type 4-way valve, in particular a proportional directional valve with individually controlled 2-way insert valves which are combined into a compact unit by assembly on a common valve housing.

In electro-hydraulic drives, spool-type proportional valves and servovalves are usually employed as the interface element between the signal-processing electronics and the hydraulic power part. In the case of applications such as those in press manufacture, in plastic injection moulding machines and metal diecasting machines and in lifting equipment, valves with a hermetic sealing function are required in order to ensure position locking and pressure retention functions. In spool valves, the leaks due to the fitting clearance necessitate additional and costly downstream seat valves. In the previous state of the art, furthermore, the spool-type proportional valves require a complicated external positional control of the valve spool In addition, the individual valves have to be separately connected both to one another and to the pump and tank connections.

In order to avoid these disadvantages of the state of the art, the object of the invention is therefore to propose a proportional directional valve in which a hermetic sealing function is ensured and in which, at the same time, external positional control of valve spools can be avoided and in which the individual valves can be accommodated in a compact manner in one housing.

An illustrative example of the invention is shown in the drawings and is described in more detail below. In the drawings.

Figure 1:
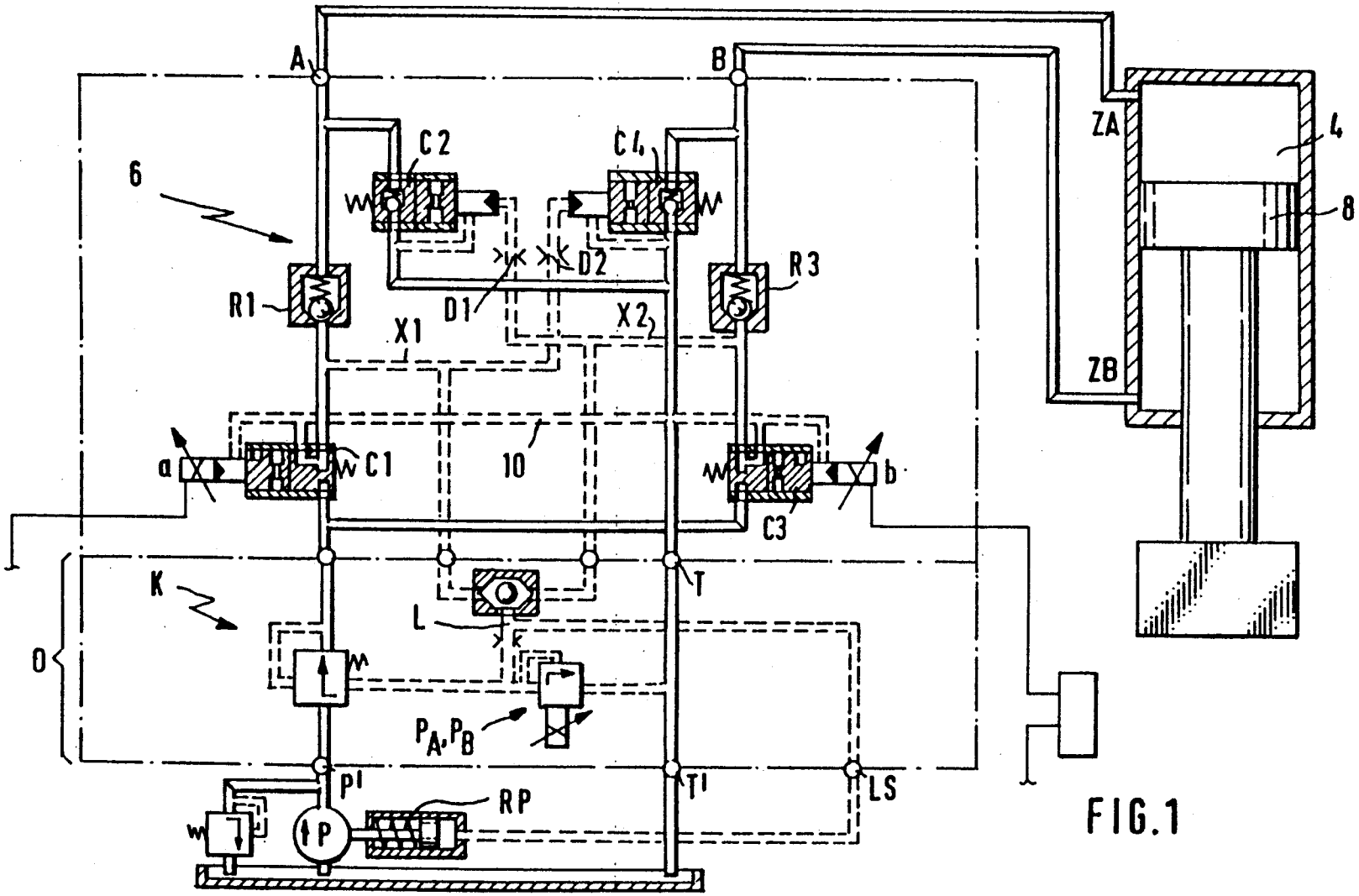
FIG. 1 shows, in symbolic representation, the control of a hydraulic cylinder by means of the proportional 4-way valve according to the invention.

FIG. 1 shows an electro-hydraulic drive, a hydraulic cylinder 4 being selected as the hydraulic power part in the application example. In certain fields of application, such as in those mentioned above, it must be possible to lock such a cylinder in a given position for safety and functional reasons. Fundamentally, this takes place by providing seat valves which prevent the hydraulic fluid from flowing back from the cylinder space into the cylinder supply conduits ZA and ZB.

According to the invention, this is achieved by means of a proportional 4-way valve 6 consisting essentially of two proportional throttle valves C1 and C3 with integrated spring return, which are manufactured by the assignee under the designation DPCMEE 16S8, and of two pilot-controlled seat-type lowering brake valves C2 and C4, non-return valves R1 and R3 being respectively associated with the outlets of the valves C1 and C3.

If the supply conduit ZA of the cylinder 4 has to be supplied with high-pressure oil, the valve Cl is opened by its control magnet a to suit the desired piston speed of the cylinder 4, by which means the supply conduit ZA is supplied with high-pressure oil via the non-return valve R1 and the operating conduit connection A of the valve 6. At the same time, the valve C4 is opened via the control conduit X1 for throttled oil return from the cylinder connection ZB to the tank connection T of the valve 6.

In order to hold the hydraulic cylinder piston 8 in a locked position, the valve C1, is-closed so that the connection ZA is now in communication with the non-return valve R1 and the connection ZB is in communication with the brake valve C4; the control conduit X1 is relieved via the valve C1 and the leakage oil return 10 to the tank connection T.

In order to supply the connection ZB, the valves C3 and C2 (the latter via the control conduit X2) are activated in an analogous manner while the locking takes place in a manner similar to that previously described.

In the case of a positive cylinder load, the lowerirg brake valves C2 and C4 are opened to the extent determined by the proportional valves C1 and C3, respectively, via the control conduits X1 and X2, respectively, i.e. the valves C1/C4 and C3/C2 mutually influence one another, depending on the load pressure. In the case of a negative load, they act as drain throttles and stop the load moving too fast and causing cavitation on the supply side. Each function of the hydraulic cylinder 4 can therefore be proportionally controlled and regulated.

The invention provides, as an alternative, an optional part O upstream of the proportional directional valve 6 according to the invention. This optional part O consists essentially of a compensator K with pressure connection P' having superimposed proportional pressure adjustment PA, PB for flow control independent of load. A load-sensing pick-up L (connection LS) is also possible in order to match the output flow when a control pump RP is used. The part O is only used, however, for the supply of energy to the proportional 4-way valve according to the invention.

Figure 2:
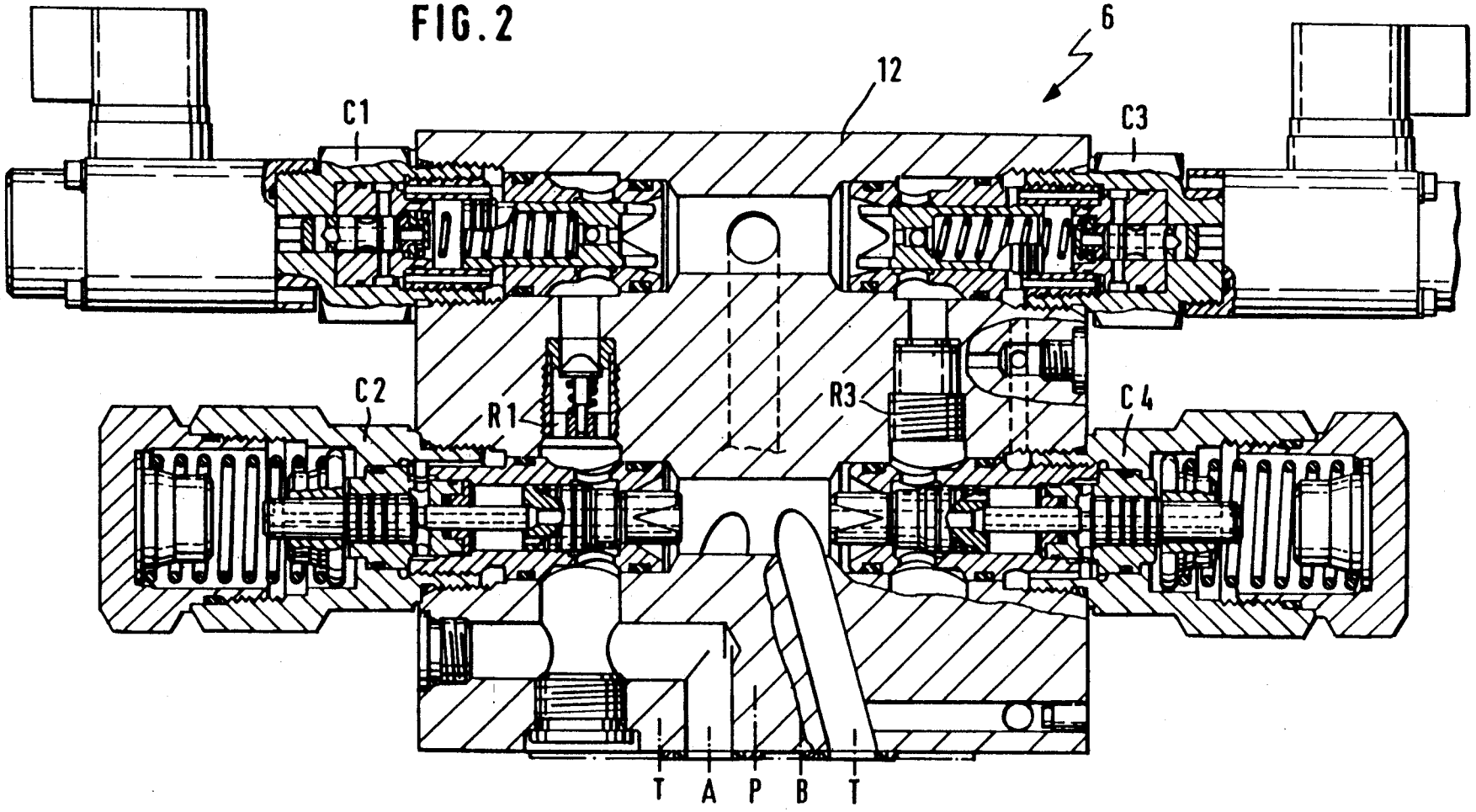
FIG. 2 shows a sectional view of the proportional directional valve according to the invention.

FIG. 2 shows, in section, a practical illustrative example of the new proportional directional valve (without the option part O from FIG. 1). The individual valves C1, C2, C3 and C4 are screw-in valves optimised for production in order to reduce costs and they are screwed into a common valve housing 12, thus providing a compact and robust valve unit (cartridge technique). The newly developed proportional throttle valves C1 and C3 have a high dynamic performance and positional accuracy without the need for additional electrical feedback because of the integrated spring return between the active cartridge of the main stage and the pilot control. Opening and closing times of 40 ms are achieved at 100% signal control and approximately 2% hysteresis.

Both the individual valve components and the proportional directional valve built up from them have been industrially tested. In the field of plastic injection-moulding machines, the proportional throttle valve has been successfully used for controlling the injection process and for screw speed during plastification. The overall proportional directional valve exhibited outstanding results in the closing unit and the ejection function during removal from the mould. The digital valve apparatus may be used with positive results in the synchronised control of calenders and lifting equipment.

The seat-type proportional directional valve according to the invention was described above in its application with overcenter valves C2 and C4.

The valve arrangement presented can also, however, be switched over in the simplest possible manner to differential operation of the cylinder 4 by opening the valves C1 and C3 simultaneously by means of their control magnets a. and b for simultaneous supply of high-pressure oil to the cylinder sides A and B, an appropriate circuit ensuring that the seat valves C2 and C4 remain closed and that the non-return valve R3 is put out of action.

It should also be noted that the seat-type proportional directional valve presented permits, due to its compact construction as shown in FIG. 2 and because of its standardised interface, direct fitting to the end of the cylinder (not shown).

This is particularly advantageous in the case of equipment and machines with several hydraulic cylinders, such as, for example, a machine with a multi-part boom and various degrees of freedom of the working unit. A machine with, for example, six hydraulic cylinders has, up to now, required two control conduits for each cylinder between the cylinder and the control part, i.e. twelve conduits. If, however, the proportional valves according to the invention are installed as proposed in the end of the cylinder, they can all be connected to a common pump conduit and a common working conduit so that only two conduits are now necessary because the control magnets can be operated electrically or even by radio.

Finally, it should again be emphasised that due to the seat-type design of the valves, hermetical sealing and hence maximum operational safety are provided by the blocking of the cylinder 4 when there is a failure in the electrical and/or high-pressure oil supply.

I claim:

1. A proportional 4-way seat-type valve comprising:
a valve housing block having:
a planar face,
connections in said block at said planar face for connections to, respectively:
(a) a pressure line,
(b) a tank line,
(c) a first working line, and
(d) a second working line;
a first passage in said housing block connecting said connection for the pressure to said connection for the first working line,
a second passage in said housing block connecting said connection for the pressure line to said connection for the second working line,
a third passage in said housing block connecting said connection for the tank line to said first passage,
a fourth passage in said housing block connecting said connection for the tank line to said second passage,
a fifth passage in said housing block connected to said first passage;
a sixth passage in said housing block connected to said second passage;
first and second electrically actuated proportional flow control valves each having a spring return therein threadedly engaging said housing block and being respectively in said first passage and said second passage and comprising means for controlling flow respectively through said first passage and through said second passage in proportion to electrical remote control signals;
a first and a second check valve respectively in said first passage and in said second passage blocking fluid return to said connection for the pressure line;
a first and second 2-way seat-type overcenter valve, each threadedly engaging said housing block and being respectively in said third and said fourth passage;
said first and second 2- way seat-type overcenter valves respectively comprising:
(a) load sensing means in direct fluid communication respectively with said sixth passage and with said fifth passage; and
(b) flow control means responsive to said load sensing means for controlling flow respectively through said third passage proportionally to fluid pressure in said second passage, and through said fourth passage proportionally to fluid pressure in said first passage.

2. The proportional 4-way seat-type valve of claim 14, and means for causing said first and second electrically actuated valve means to open simultaneously to therby connect said pressure line connection to said connections to said working lines, said pressure responsive means for controlling the flow of fluid through said seat valves comprising means for maintaining said seat valves closed.

3. The proportional 4-way seat-type valve of claim 1, and further comprising a pressure line connected to said first mentioned connection, means for compensating pressure in said pressure line, means for causing said pressure compensating means to vary the pressure in said pressure line independent of load applied to a said working line.

4. The proportional 4-way seat-type valve of claim 3, and further comprising a control pump having an outlet connected to the inlet of said pressure compensating means, and means for controlling said pump comprising means responsive to pressure in a said working line.

5. The proportional 4-way seat-type valve of claim 3, and means for causing said first and second electrically actuated valve means to open simultaneously to thereby connect said pressure line connection to said connections to said working lines, said pressure responsive means for controlling the flow of fluid through said seat valves comprising means for maintaining said seat valves closed.

* * * * *